US010618604B2

(12) United States Patent
Clift

(10) Patent No.: US 10,618,604 B2
(45) Date of Patent: Apr. 14, 2020

(54) SYSTEM AND APPARATUS FOR POSITIONING A FLOATATION DEVICE

(71) Applicant: Kristi Ann Clift, Coppell, TX (US)

(72) Inventor: Kristi Ann Clift, Coppell, TX (US)

( * ) Notice: Subject to any disclaimer, the term of this patent is extended or adjusted under 35 U.S.C. 154(b) by 474 days.

(21) Appl. No.: 15/345,486

(22) Filed: Nov. 7, 2016

(65) Prior Publication Data

US 2018/0127063 A1 May 10, 2018

(51) Int. Cl.
*B63B 21/08* (2006.01)
*B63B 21/20* (2006.01)
*B63B 21/00* (2006.01)

(52) U.S. Cl.
CPC ..... *B63B 21/08* (2013.01); *B63B 2021/006* (2013.01); *B63B 2021/203* (2013.01)

(58) Field of Classification Search
CPC .... B63B 21/08; B63B 21/20; B63B 2021/203
See application file for complete search history.

(56) References Cited

U.S. PATENT DOCUMENTS 3,858,877 A * 1/1975 Lundstrom ..... A63B 67/04 473/14
4,729,331 A * 3/1988 Eggleston ..... B63B 21/00 114/230.26
4,775,346 A * 10/1988 Gunter ..... A63B 67/007 114/293
5,460,113 A * 10/1995 Gunter ..... B63B 21/00 114/230.2
5,601,514 A * 2/1997 Horn ..... A63B 69/12 434/254
5,810,632 A * 9/1998 Huston, III ..... B63B 21/00 441/129
6,475,048 B2 * 11/2002 Gredy ..... B63B 21/00 114/230.1
D594,524 S * 6/2009 Oliva ..... D21/803
7,867,049 B1 * 1/2011 Doffay ..... B63B 35/58 114/345
8,790,148 B2 * 7/2014 Ehrat ..... B63B 35/85 441/129
9,199,696 B1 * 12/2015 Bonell ..... B63B 21/20
2001/0036782 A1 * 11/2001 Gredy ..... B63B 21/00 441/129
2013/0183878 A1 * 7/2013 Ehrat ..... B63B 35/85 441/129
2018/0127063 A1 * 5/2018 Clift ..... B63B 21/08

* cited by examiner

*Primary Examiner* — S. Joseph Morano
*Assistant Examiner* — Jovon E Hayes
(74) *Attorney, Agent, or Firm* — Mirna Abyad

(57) ABSTRACT

A positioning apparatus and system for keeping a floatation device from moving that includes at least one surface coupling apparatus to couple the positioning apparatus to a surface adjacent to a body of water, wherein the surface coupling apparatus locks into a flat surface securely, at least one non-slip floatation coupler to grasp to a floatation device, the non-slip flotation coupler grasps to any floatation device securely by gripping to any portion of the floatation device, and at least one extension line coupled to the surface coupling apparatus and the non-slip floatation coupler, the at least one extension line maintains drifting of the floatation device to unwanted location.

18 Claims, 5 Drawing Sheets

SYSTEM AND APPARATUS FOR POSITIONING A FLOATATION DEVICE

FIELD OF THE INVENTION

The disclosure relates to systems and methods for positioning a floatation device. In particular, the disclosure relates to a system and apparatus that facilitates a floatation device to maintain a desirable position or location.

BACKGROUND OF THE INVENTION

Floatation devices are of many type and various use. Some floatation devices are designed to assist a non-swimmer to float, others are for the enjoyment of laying in the sun while floating, and others are to float objects. In all these situations, the floatation device may drift outside the desirable range of location. Current solutions require utilizing special floatation devices that are designed to work with specific location maintaining apparatus or system. Other current solutions, require the modification of the floatation device to comply with the requirements of such systems or apparatus.

Thus, there is a need for a system or apparatus for positioning variable types of floatation devices without the need to modify such a device.

SUMMARY OF THE INVENTION

Embodiments described herein relate to a positioning apparatus and system for keeping a floatation device from moving that includes at least one surface coupling apparatus to couple the positioning apparatus to a surface adjacent to a body of water, wherein the surface coupling apparatus locks into a flat surface securely, at least one non-slip floatation coupler to grasp to a floatation device, the non-slip flotation coupler grasps to any floatation device securely by gripping to any portion of the floatation device, and at least one extension line coupled to the surface coupling apparatus and the non-slip floatation coupler, the at least one extension line maintains drifting of the floatation device to unwanted location.

In another embodiment, described herein are embodiments relating to a positioning apparatus for keeping a floatation device from moving that includes at least one surface coupling apparatus to couple the positioning apparatus to a surface adjacent to a body of water, wherein the surface coupling apparatus locks into a flat surface securely, at least one body band coupler to grasp to a person utilizing the floatation device, wherein the body band coupler couples to any portion of a person's body; and at least one extension line coupled to the surface coupling apparatus and the body band coupler, wherein the at least one extension line maintains drifting of the floatation device to unwanted location.

BRIEF DESCRIPTION OF DRAWINGS

Reference will now be made to the following drawings.

DETAILED DESCRIPTION

Figure 1:
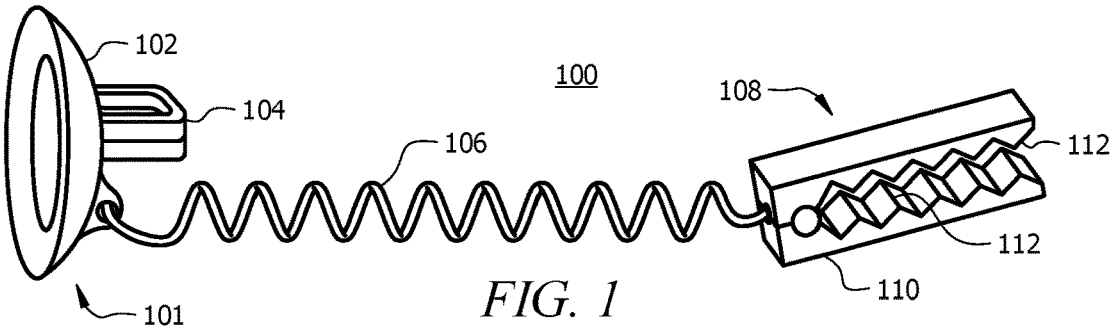
FIG. 1 is an embodiment illustrating a floatation device positioning apparatus and system utilizing a suction cup with a locking mechanism and a non-slip floatation coupler with teeth.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

It will be appreciated by those skilled in the art that aspects of the present disclosure may be illustrated and described herein in any of a number of patentable classes or context including any new and useful process, machine, manufacture, or composition of matter, or any new and useful improvement thereof.

Aspects of the present disclosure are described herein with reference to diagrams illustrations of apparatus or systems according to various embodiments of the disclosure. It will be understood that each diagram illustrations may be implemented by combining the illustration of various designs presented in the different figures. The figures are merely illustrative and are not intended to limit the various designs.

FIG. 1 is an embodiment illustrating a floatation device positioning apparatus or system 100 utilizing a surface coupling apparatus 101 described as a suction cup 102 with a locking mechanism 104 and a non-slip floatation coupler 108 described as a clip 110, with teeth 112, and an extension line 106.

The positioning system 100 is utilized to keeping a floatation device from moving on a body of water, such as a pool. The surface coupling apparatus is designed to couple the positioning apparatus 100 to a surface adjacent to a body of water. The surface coupling apparatus 101 locks into a flat surface securely. In this embodiment, the surface coupling apparatus 101 further uses a locking mechanism 104 to lock the suction cup 102 even more securely. Various types of surface coupling apparatuses 101 may use different type of locking mechanism 104. In another embodiment, the positioning system 100 does not use a locking mechanism 104. The surface coupling apparatus 101 may be a suction cup, a vice clamp, and the like. The surface coupling apparatus 101 may include one or more of the following: a locking mechanism to lock the surface coupling apparatus in position and/or a retractable device to allow the extension line to change length, to be retracted and/or for safe keeping.

Figure 6:
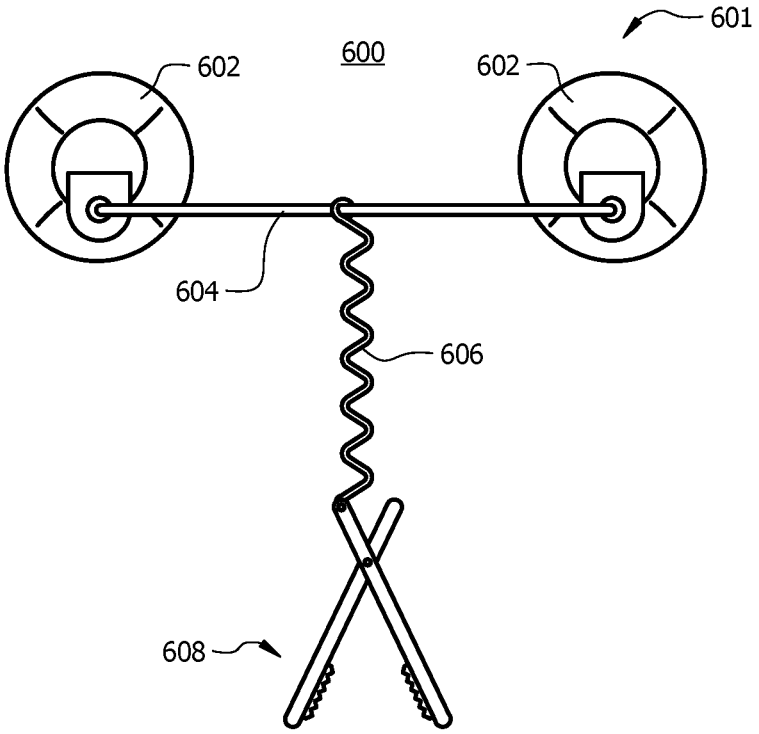
FIG. 6 is an embodiment illustrating a floatation device positioning apparatus and system utilizing multiple suction cup joined with a coupler with an extension line extending from the coupler.
Figure 7:
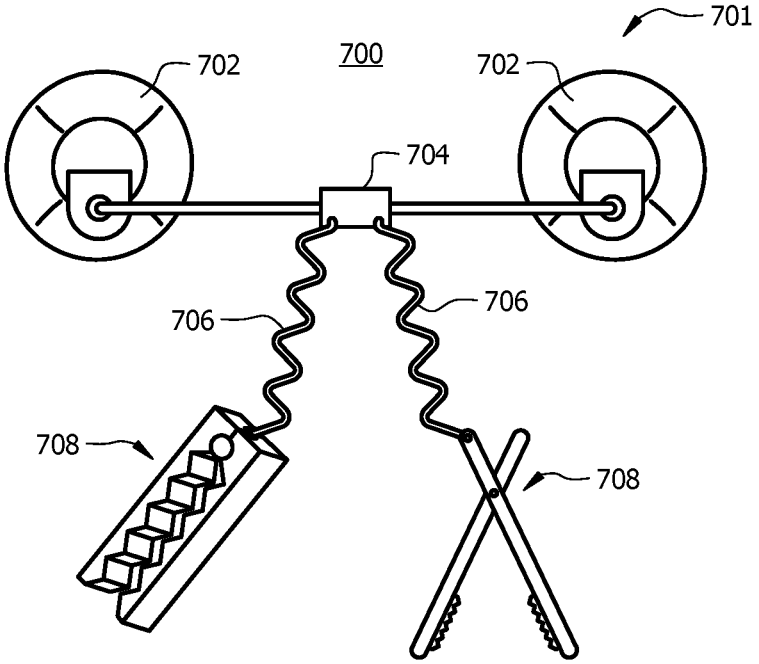
FIG. 7 is an embodiment illustrating a floatation device positioning apparatus and system utilizing multiple suction cup joined with a coupler with multiple extension lines extending from the coupler.

The non-slip floatation coupler 110 grasp to variable types of floatation devices. The non-slip flotation coupler 110 grasps to any floatation device securely by gripping to any portion of the floatation device. The extension line 106 coupled to the surface coupling apparatus 101 and the non-slip floatation coupler 108. The extension line 106 maintains drifting of the floatation device to unwanted location. In one embodiment, more than one surface coupling apparatus 101 is coupled with a coupling device, such as, a bar, a handle or the likes. In such an embodiment, the coupling apparatus may be coupled to the one or more extension line 106. The extension line 106 may be contained and/or extend from the coupling device, that couples the multiple surface coupling apparatus 101, an embodiment is shown in FIG. 6 and FIG. 7. The extension line 106 may be contained within the coupling apparatus capable of at least one of extending and retracting out and into of the coupling apparatus.

The non-slip floatation coupler 108 may be any of the following: a clip with teeth to grasp to any flotation device, a clip with teeth to grasp to any flotation device and wherein the teeth do not deflate the floatation device, a body band, a suction cup, Velcro, a vice clamp and a non-slip surface to grasp to any floatation device and wherein the non-slip surface is in direct contact with the floatation device, and the like. In one embodiment, the surface coupling apparatus 101 and the non-slip floatation coupler 108 may be detachable and interchangeable to comprise at least one of teeth to grasp to any flotation device, teeth to grasp to any flotation device and wherein the teeth do not deflate the floatation device, a body band, a suction cup, Velcro, a vice clamp and a non-slip surface to grasp to any flotation device and wherein the non-slip surface is in direct contact with the floatation device.

In one embodiment, the positioning apparatus may include multiple surface coupling device 101, of different type, multiple extension lines 106 of different types, and/or multiple non-slip floatation coupler, of different types. For example, the flotation position apparatus may have two non-slip floatation couplers 108 coupled to two extension lines 106, respectively, each of the non-slip flotation coupler 108 grasps to a different portion of the flotation device. An example of such an embodiment is shown in FIG. 3, FIG. 4 and FIG. 7.

The extension line 106 may be one or more of the following: spring shape, plastic, rubber, metal, cord, clothline, water proof material, water resistant material, fabric, elastic, bungee-cord, rope, and the likes. In one embodiment, the extension line 106 wraps around the floatation device, wraps back and grasps to the surface coupling apparatus 101, the extension line 106 and/or adjacent to the flat surface, which will be described below in FIG. 5.

Figure 2:
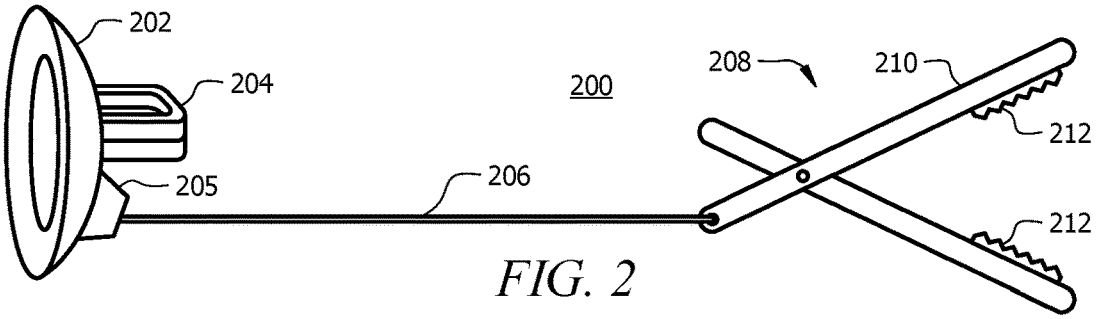
FIG. 2 is an embodiment illustrating a floatation device positioning apparatus and system utilizing a suction cup with a retractable extension line and a non-slip floatation coupler with a non-slip surface.

FIG. 2 is an embodiment illustrating a floatation device positioning apparatus and system 100 utilizing a surface coupling apparatus 201 described as a suction cup 202 with a retractable mechanism 204 and a locking mechanism 205, a non-slip floatation coupler 208 described as a clip 210, with no slip surface 212, and an extension line 206. The extension line 206 is shown as a cord. The cord may be designed of any suitable materials. The retractable mechanism 204 is used to contain, stretch, and retract the extension line 206. Any number of extension line 206 may be used in such an embodiment with various types and numbers of surface coupling apparatus 201 and/or various types and numbers of non-slip floatation couplers 208.

Figure 3:
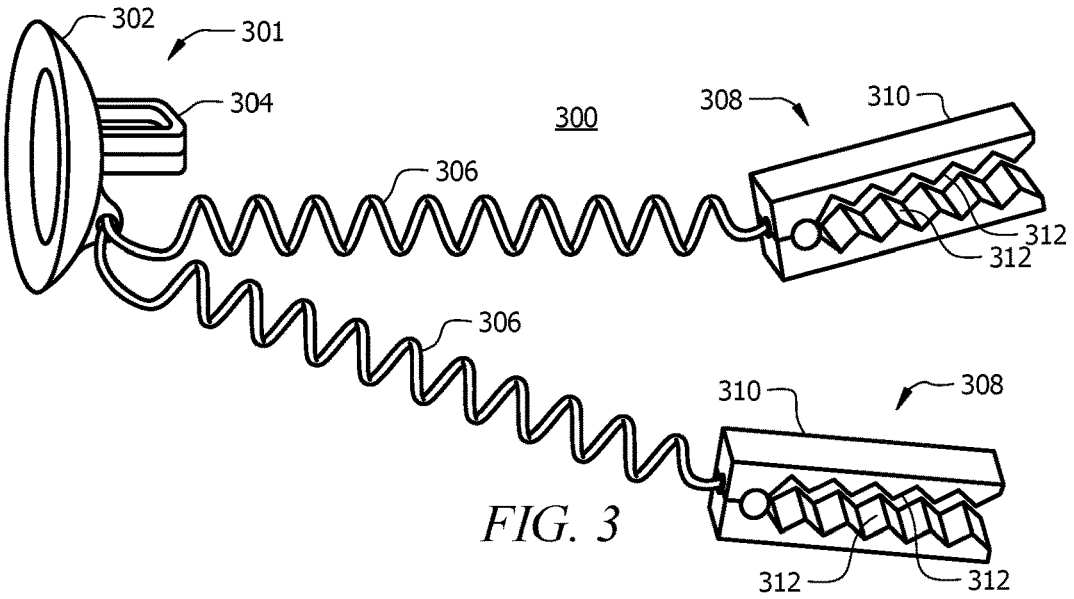
FIG. 3 is an embodiment illustrating a floatation device positioning apparatus and system utilizing a single suction cup, two extension lines, and two non-slip floatation coupler.
Figure 4:
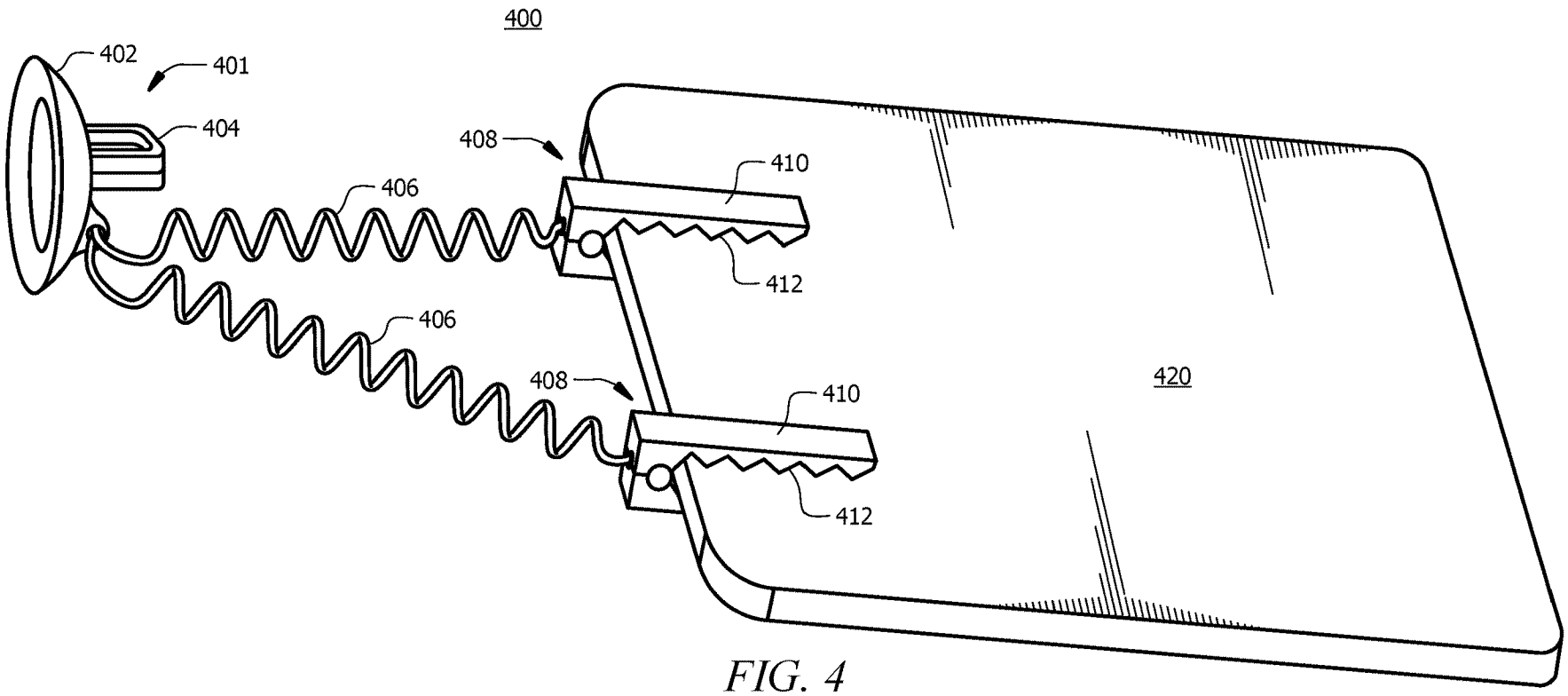
FIG. 4 is an embodiment illustrating a floatation device positioning apparatus and system in an illustrative use.

FIG. 3 is an embodiment illustrating a floatation device positioning apparatus and system 300 utilizing a single surface coupling apparatus 301, described as a suction cup 302, with two non-slip floatation coupler 308, described as two clips 310, with teeth surface 312, locking mechanism 304 and two extension lines 306. The extension lines 306 are shown as springs but they may be designed of any suitable materials. It is to be noted that any number of extension lines 306 may be used in such an embodiment with various types and numbers of surface coupling apparatus 301 and/or various types and numbers of non-slip floatation couplers 308.

Figure 5:
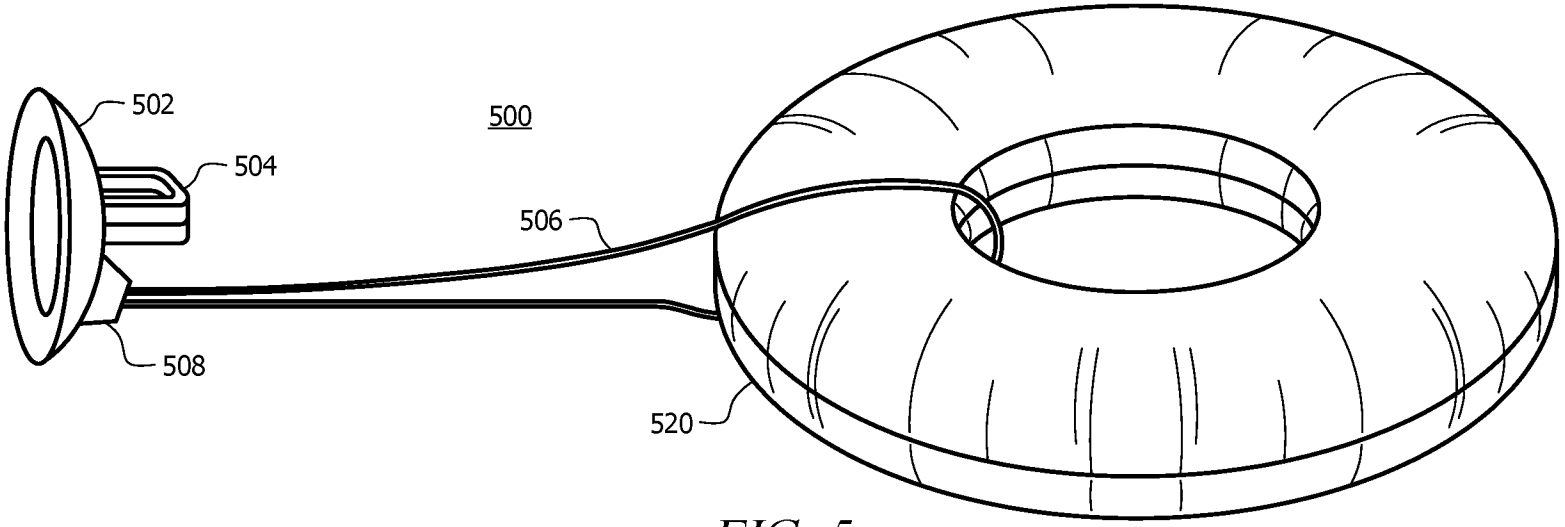
FIG. 5 is another embodiment illustrating a floatation device positioning apparatus and system in another illustrative use.

FIG. 4 is an embodiment illustrating a floatation device positioning apparatus and system 400 in an illustrative use. In this embodiment, the floatation device positioning apparatus 400 utilizes a single surface coupling apparatus 401, described as a suction cup 402, with two non-slip floatation coupler 408, described as two clips 410, with non-slip surface 412, and two extension lines 406. The extension lines 406 are shown as springs but they may be designed of any suitable materials. It is to be noted that any number of extension lines 406 may be used in such an embodiment with various types and numbers of surface coupling apparatus 401 and/or various types and numbers non-slip floatation couplers 408. The floatation device positioning apparatus 400 is used in conjunction with a floatation device 420, which may be a foam, an air blown, mesh, a raft, a tube, a child floatation device, a floating seat, a floating object, and the likes. The floatation device 420 may be designed of any material and may float utilizing various floatation mechanism, substance and/or materials. The floatation device positioning apparatus 400 may be coupled to any portion of the floatation device 420. For example, as shown in FIG. 5, a floatation device positioning apparatus and system 500 may be wrapped around a tube and coupled utilizing a non-slip floatation coupler 508 to an extension line 506, to a surface coupling apparatus 502, and/or to a coupling attachment 504 coupled to the surface coupling apparatus 502.

FIG. 6 is an embodiment illustrating a floatation device positioning apparatus and system 600. In this embodiment, the floatation device positioning apparatus 600 utilizes multiple surface coupling apparatus 601, described as two suction cups 602 which may or may not be connected, for example by connector 604. FIG. 6 illustrates with two non-slip floatation coupler 608, described as two clips 610 and two extension lines 606 coupled to the connector 604. In this embodiment, the floatation device positioning apparatus and system 600 utilizes a single extension line 606, shown as a spring, but they may be designed of any suitable materials in any shape. It is to be noted that any number of extension lines 606 may be used in such an embodiment with various types and numbers of surface coupling apparatus 601 and/or various types and numbers of non-slip floatation couplers 608.

FIG. 7 is an embodiment illustrating a floatation device positioning apparatus and system 700 utilizing multiple surface coupling apparatus 701, shown as multiple suction cup 702, joined with a connector with multiple extension lines 706 extending from the connector. In this embodiment, the floatation device positioning apparatus 700 utilizes multiple surface coupling apparatus 701, described as two suction cups 702 which are, in this embodiment, coupled by connector 704. FIG. 7 illustrates two non-slip floatation coupler 708, described as a suction cup and a body band coupler and two extension lines 706 enclosed in and/or via the connector 704. In this embodiment, the floatation device positioning apparatus and system 700 utilizes two extension lines 706, shown as a cord, but they may be designed of any suitable materials in any shape. It is to be noted that any number of extension lines 706 may be used in such an embodiment with various types and numbers of surface coupling apparatus 701 and/or various types and numbers of non-slip floatation couplers 708.

In an embodiment that utilizes a body band coupler, the floatation device positioning apparatus and system 700 may couple to any portion of a person, rather than a floatation device. The body band coupler may couple to an ankle, a wrist, a finger, a waste, or the like. The floatation position apparatus 700 may utilize any number of body bands coupled to one or more extension lines 706.

Figure 8:
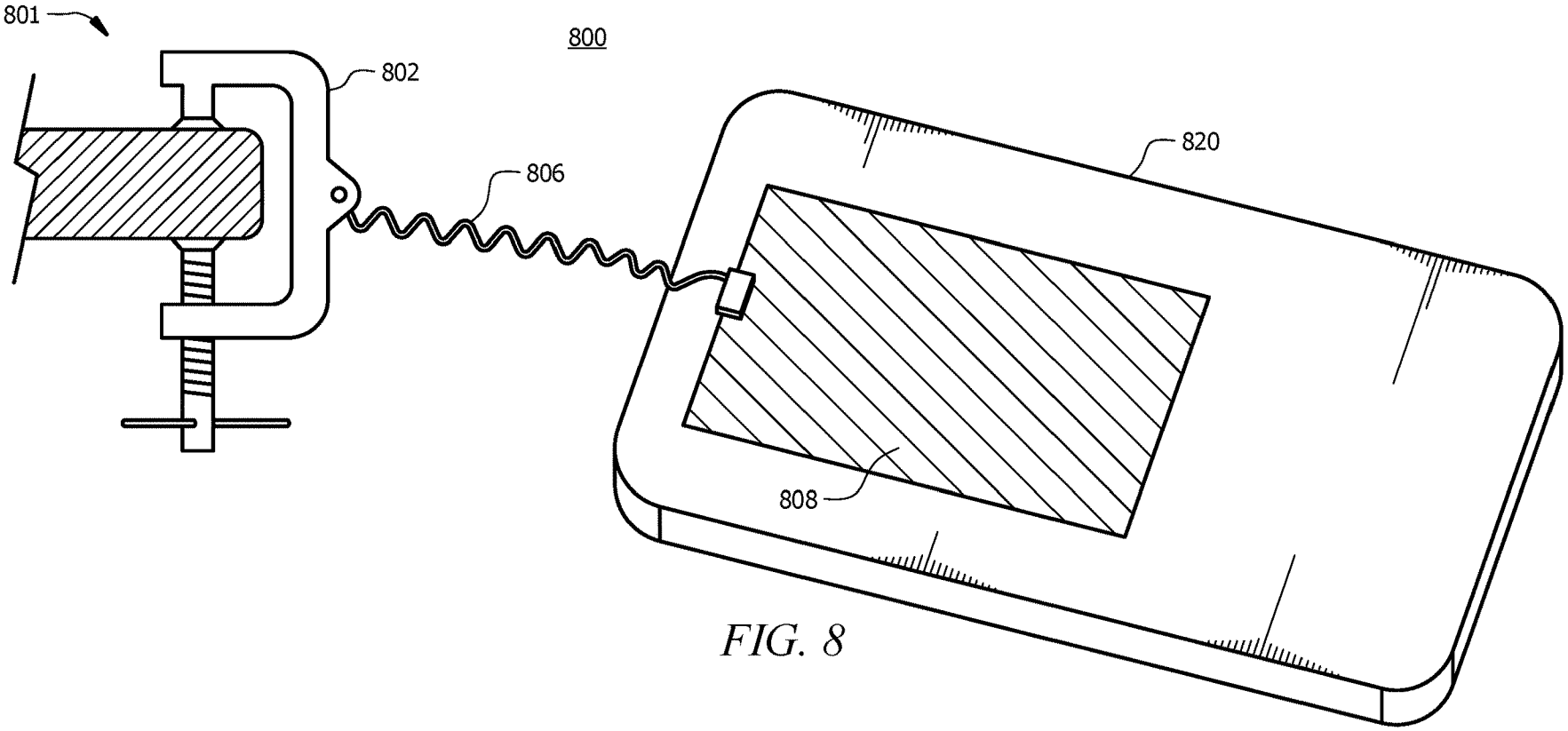
FIG. 8 is an embodiment illustrating a floatation device positioning apparatus and system utilizing a vice clamp and a weight sheet.

FIG. 8 is an embodiment illustrating a floatation device positioning apparatus and system 800 utilizing a single surface coupling apparatus 801, shown as vice clamp 802. In this embodiment, the floatation device positioning apparatus 800 utilizes a single non-slip floatation coupler 808, described as a weight sheet 808 coupled to the surface coupling apparatus 801 with a single extension line 806, which may or may not be retractable. The surface coupling apparatus 801 may use one or more locking mechanism, not shown in FIG. 8. In this embodiment, the floatation device positioning apparatus and system 800 utilizes a single extension line 806, shown as a cord, but it may be designed of any suitable materials in any shape. It is to be noted that any number of extension lines 806 may be used in such an embodiment with various types and numbers of surface coupling apparatus 801 and/or various types and numbers of non-slip floatation couplers 808.

In this embodiment, the weight sheet 808 is placed in contact with a floatation device 820. The weight sheet 808 may include a non-slip surface and/or may lay over or on the floatation device 820 utilizing its weight to secure itself to the flotation device 820. The weight sheet does not cause the raft to sink. In this embodiment only one weight sheet 808 is shown, however, any number of weight sheets 808 may be used. Thus, it is to be noted that any number of weight sheet 808 may be used in such an embodiment with various types and numbers of surface coupling apparatus 801 and/or various types and numbers of non-slip floatation couplers 808. For example, two weight sheets may be coupled to two extension lines. The weight sheet 808 may utilize a Velcro, a magnet and suction to maintain contact with the floatation device, may include a non-slip side and/or a towel side. In such embodiments, the flotation device is not altered in ordered to be coupled to the flotation position apparatus.

It will be appreciated by those skilled in the art that changes could be made to the embodiments described above without departing from the broad inventive concept. It is understood, therefore, that this disclosure is not limited to the particular embodiments herein, but it is intended to cover modifications within the spirit and scope of the present disclosure as defined by the appended claims.

What is claimed is:

1. A positioning apparatus for keeping a floatation device from moving, comprising:

at least one surface coupling apparatus to couple the positioning apparatus to a surface adjacent to a body of water, wherein the surface coupling apparatus locks into a flat surface securely;

at least one body band coupler to grasp to a person utilizing the floatation device, wherein the body band coupler couples to a person's at least one of finger, wrist or ankle, and wherein the floatation device is at least one of raft or a floating seat; and at least one extension line coupled to the surface coupling apparatus and the body band coupler, wherein the at least one extension line maintains drifting of the floatation device to unwanted location.

2. The flotation position apparatus of claim 1, wherein the surface coupling apparatus is at least one of a suction cup or a vice clamp.

3. The flotation position apparatus of claim 1, wherein the at least one surface coupling apparatus comprises at least one of a locking mechanism to lock the surface coupling apparatus in position, a retractable device to allow the extension line to at least one of change length and to be retracted, and a variable width opening to grasp to different width floatation devices.

4. The flotation position apparatus of claim 1, wherein more than one surface coupling apparatus are coupled with a connector.

5. The flotation position apparatus of claim 4, wherein the connector at least one of is coupled to the at least one extension line or the at least one extension line is contained within the connector capable of at least one of extending and retracting out and into of the connector.

6. The flotation position apparatus of claim 1, wherein the at least one extension line is at least one of a spring shape, plastic, rubber, metal, cord, cloth-line, water proof material, water resistant material, fabric, elastic, bungee-cord, and rope.

7. The flotation position apparatus of claim 1, wherein the at least one flotation position apparatus comprises two body bands couplers coupled to two extension lines, respectively, wherein each of the body band coupler grasps to a different portion of the flotation device.

8. The flotation position apparatus of claim 1, wherein the at least one flotation device is not altered in ordered to be coupled to the flotation position apparatus.

9. A positioning apparatus for keeping a floatation device from moving, comprising:

a surface coupling apparatus to couple the positioning apparatus to a surface adjacent to a body of water, wherein the surface coupling apparatus locks into a flat surface securely;

at least one weight sheet, wherein the weight sheet is non-slip and at least one of lays over or on the floatation device utilizing at least weight to secure itself to the flotation device, and wherein the weight sheet utilizes at least one of a strip fastener, a magnet and suction to maintain contact with the floatation device; and at least one extension line coupled to the surface coupling apparatus and the non-slip floatation coupler, wherein the at least one extension line maintains drifting of the floatation device to unwanted location.

10. The flotation position apparatus of claim 9, wherein the surface coupling apparatus is at least one of a suction cup or a vice clamp.

11. The flotation position apparatus of claim 9, wherein the at least one surface coupling apparatus comprises at least one of a locking mechanism to lock the surface coupling apparatus in position and a retractable device to allow the extension line to at least one of change length and to be retracted.

12. The flotation position apparatus of claim 9, wherein more than one surface coupling apparatus are coupled with a connector.

13. The flotation position apparatus of claim 12, wherein the connector at least one of is coupled to the at least one extension line or the at least one extension line is contained within the connector capable of at least one of extending and retracting out and into of the connector.

14. The flotation position apparatus of claim 9, wherein the at least one extension line is at least one of a spring shape, plastic, rubber, metal, cord, cloth-line, water proof material, water resistant material, fabric, elastic, bungee-cord, and rope.

15. The flotation position apparatus of claim 9, wherein the at least one flotation position apparatus comprises two weight sheets coupled to two extension lines, respectively.

16. The flotation position apparatus of claim 9, wherein the at least one flotation device is not altered in ordered to be coupled to the flotation position apparatus.

17. The floatation position apparatus of claim 9, wherein the weight sheet comprises a non-slip side and a towel side.

18. The floatation position apparatus of claim 9, wherein the weight sheet does not cause the raft to sink.

* * * * *